US011368792B1

(12) United States Patent
Kervran

(10) Patent No.: US 11,368,792 B1
(45) Date of Patent: Jun. 21, 2022

(54) SOUND TRANSDUCER AND ELECTRONIC DEVICE

(71) Applicant: AAC Acoustic Technologies (Shenzhen) Co., Ltd., Shenzhen (CN)

(72) Inventor: Yannick Kervran, HK (FR)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/137,400

(22) Filed: Dec. 30, 2020

(51) Int. Cl.
*H04R 19/00* (2006.01)
*H04R 9/02* (2006.01)
*H04R 1/02* (2006.01)

(52) U.S. Cl.
CPC ..... *H04R 9/02* (2013.01); *H04R 1/02* (2013.01); *H04R 2201/003* (2013.01)

(58) Field of Classification Search
CPC .... H04R 19/005; H04R 19/00; H04R 19/016; H04R 2201/003; B81B 2203/0136
See application file for complete search history.

(56) References Cited

U.S. PATENT DOCUMENTS 8,265,309 B2 * 9/2012 Zhang ..... H04R 19/005 381/174
8,755,556 B2 * 6/2014 Cohen ..... H04R 31/00 381/398
9,402,137 B2 * 7/2016 Hsu ..... H04R 19/005
9,510,121 B2 * 11/2016 Xu ..... H04R 1/04
9,728,653 B2 * 8/2017 Dehe ..... H04R 19/005
9,809,444 B2 * 11/2017 Klein ..... B81B 3/0021
9,826,313 B2 * 11/2017 Pinkerton ..... H04R 19/02
9,938,133 B2 * 4/2018 Kautzsch ..... B81B 3/0021
10,715,925 B2 * 7/2020 Zhang ..... B81B 3/0021
11,117,795 B2 * 9/2021 Hashiguchi ..... B81B 7/02
11,159,893 B1 * 10/2021 Kervran ..... B81B 3/0021
2002/0118850 A1 * 8/2002 Yeh ..... B81B 3/0072 381/313
2021/0211793 A1 * 7/2021 Wu ..... H04R 1/08
2021/0331912 A1 * 10/2021 Hsu ..... B81C 1/00166
2021/0376767 A1 * 12/2021 Hashiguchi ..... B81B 3/00

FOREIGN PATENT DOCUMENTS

WO WO-2020139860 A1 * 7/2020 ..... H04R 19/005
WO WO-2021134308 A1 * 7/2021 ..... H04R 19/04
WO WO-2021134679 A1 * 7/2021 ..... H04R 19/00

* cited by examiner

*Primary Examiner* — Ryan Robinson
(74) *Attorney, Agent, or Firm* — W&G Law Group

(57) ABSTRACT

A sound transducer, including: a substrate including a cavity and a first surface oriented to the cavity; a fixed part extending from the first surface into the cavity, and including a fixed end disposed on the first surface and a free end opposite to the fixed end; a moving part fixed on the substrate and disposed over the cavity, partially covering the cavity, and including a second surface oriented to the cavity; a first electrode, fixed on the free end; and a second electrode fixed on the second surface. The first electrode is laterally adjacent to the second electrode. The sound transducer has higher sensitivity and the first electrode has stronger stability, thereby improving the performance of the sound transducer.

18 Claims, 12 Drawing Sheets

C-C

E-E

G-G

SOUND TRANSDUCER AND ELECTRONIC DEVICE

FIELD OF THE INVENTION

The disclosure relates to the field of an acoustic-electric conversion device, and more particularly to a sound transducer and an electronic device comprising the same.

BACKGROUND OF THE INVENTION

The micro-electro-mechanical-system (MEMS) based transducers include a series of sensors and actuators produced by micro machining technology. In general, MEMS can be used in such device as accelerometers, microphones, micromotors, micropumps, microvibrators, pressure sensors, gyroscopes, humidity sensors, etc. Many MEMS devices use capacitance sensing technology to convert physical signals into electrical signals. In such applications, an interface circuit operates to convert the capacitance change in the sensor into a voltage signal. In the related art, the moving part covers at least part of the cavity defined by a substrate; the moving electrode is disposed on the moving part, and the fixed electrode is disposed on the substrate. However, the following disadvantages are associated with the design, that is, either the sensitivity of the vibration of the moving part transmitted to the moving electrode is low, or the fixed electrode is suspended in the air, and the mechanical noise tends to cause the fixed electrode to move. The design adversely affects the acoustic energy exchange performance of the transducer.

Therefore, it is necessary to provide a sound transducer and an electronic device comprising the same with improved working performance.

SUMMARY OF THE INVENTION

In one respect, the disclosure provides a sound transducer that has improved sensitivity and can improve the stability of the fixed electrode.

In another respect, the disclosure further provides an electronic device comprising a sound transducer having improved working performance and sensitivity.

Provided is a sound transducer, comprising: a substrate comprising a cavity and a first surface oriented to the cavity; a fixed part extending from the first surface into the cavity, and comprising a fixed end disposed on the first surface and a free end opposite to the fixed end; a moving part fixed on the substrate and disposed over the cavity, partially covering the cavity, and comprising a second surface oriented to the cavity; a first electrode, fixed on the free end; and a second electrode fixed on the second surface. The first electrode is laterally adjacent to the second electrode.

Further, the first electrode and the second electrode are extendable in a direction perpendicular to the moving part.

Further, the first electrode comprises a plurality of first comb fingers; the second electrode comprises a plurality of parallel members each comprising two parallel fingers, the plurality of first comb fingers each is disposed between two corresponding parallel fingers, and is spaced apart from the two parallel fingers; or the second electrode comprises a plurality of U-shaped members each comprising two parallel fingers and a connection finger connecting the two parallel fingers, the plurality of first comb fingers each is disposed between two corresponding parallel fingers, and is spaced apart from the two parallel fingers.

Further, the free end comprises a plurality of electrode slots perpendicular to the moving part; the plurality of electrode slots forms the first electrode; the plurality of electrode slots each comprises a first slot part; the second electrode comprises a plurality of second comb fingers; and the plurality of second comb fingers each is disposed in a corresponding first slot part.

Further, the first slot part comprises two first side walls and a first bottom wall connecting the two first side walls; the two first side walls are opposite to each other; the first bottom wall is disposed on one end of each of the two first side walls away from the moving part and is opposite to the moving part; and the plurality of second comb fingers each is spaced apart from two corresponding first side walls and a corresponding first bottom wall.

Further, the first slot part further comprises a connection wall extending along a direction perpendicular to the moving part; the connection wall is connected to the two first side walls and the first bottom wall; a plurality of first slot parts are arranged in a semicircle or circle, and a center of the semicircle or circle is disposed on one end of the connection wall.

Further, a plurality of first slot parts intersects on an intersection point, and the plurality of first slot parts is radially distributed from the intersection point.

Further, a depression is disposed between two first side walls of two adjacent first slot parts, and extends from one end of the fixed part opposite to the moving part along a direction away from the moving part.

Further, the fixed part further comprises a connection part connecting the fixed end and the free end; and the depression is disposed on both the connection part and the fixed end.

Further, a depression is disposed on the center of the semicircle or circle, and extends from one end of the fixed part opposite to the moving part along a direction away from the moving part.

Further, the plurality of electrode slots each comprises a second slot part disposed on one end of the first slot part away from the center and intersecting with the first slot part; the second electrode comprises a plurality of third comb fingers connecting to the plurality of second comb fingers, respectively, and disposed in the second slot part.

Further, the plurality of electrode slots each comprises a second slot part disposed on one end of the first slot part away from the intersection point and intersecting with the first slot part; the second electrode comprises a plurality of third comb fingers connecting to the plurality of second comb fingers, respectively, and disposed in the second slot part.

Further, the second slot part comprises two second side walls and a second bottom wall connecting the two second side walls; the two second side walls are opposite to each other; the second bottom wall is disposed on one end of each of the two second side walls away from the moving part and is opposite to the moving part; and the plurality of third comb fingers each is spaced apart from two corresponding second side walls and a corresponding second bottom wall.

Further, each first side wall is provided with an insulation layer; the first side wall comprises a first conductive part, the insulation layer, and a second conductive part consecutively; the plurality of second comb fingers each comprises a first finger surface, a second finger surface opposite to the first finger surface, and an interlayer disposed between the first finger surface and the second finger surface; the first finger surface and the second finger surface are opposite to the two first side walls of the first slot part, respectively; the first finger surface and the second finger surface each comprise an insulation area and a conductive area in a direction from the moving part to the fixed part, and the interlayer is conductive; and the first conductive part is opposite to the insulation area and the conductive area.

Further, the moving part comprises a vent hole.

According to another embodiment of the disclosure, an electronic device comprising the sound transducer is provided.

Advantages of the sound transducer of the disclosure are summarized as follows. The second electrode is fixed on the second surface of the moving part, and is located in the center of the moving part. The fixed part extends from the substrate to the cavity, so that the first electrode fixed on the free end is laterally adjacent to the second electrode. When the moving part vibrates under the action of an external force such as sound pressure, the second electrode is driven to move in a reciprocating motion relative to the first electrode, so as to improve the sensitivity of the sound transducer. The first electrode is fixed on the fixed part to improve the stability of the first electrode 4, so as to avoid the displacement of the first electrode caused by mechanical noise and other factors and thus improving the performance of the sound transducer. Therefore, the sound transducer provided by the disclosure has higher sensitivity and the first electrode has stronger stability, thereby improving the performance of the sound transducer.

Figure 1:
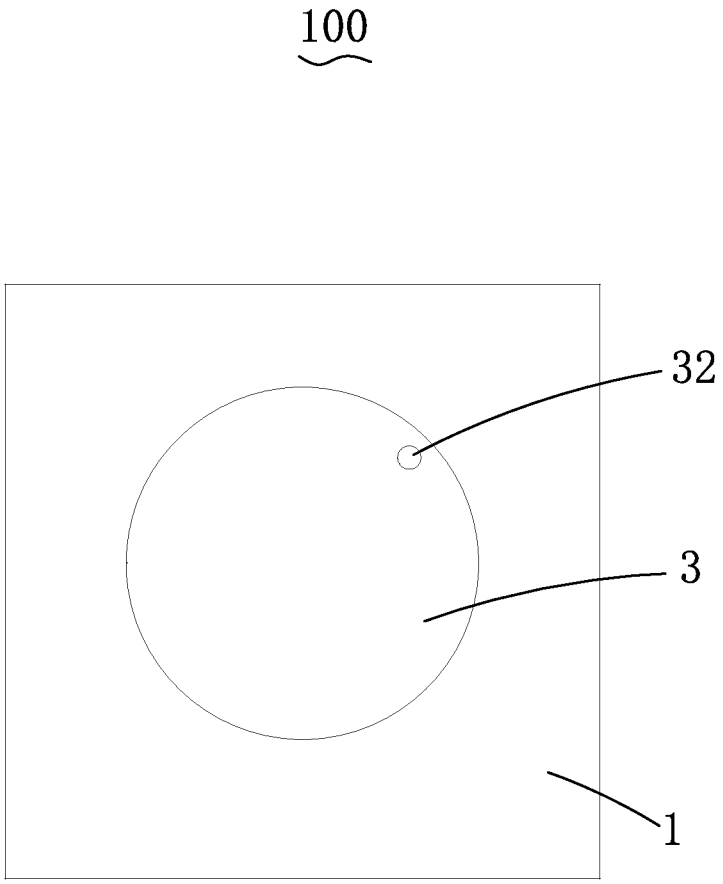
FIG. 1 is a top view of a sound transducer according to Example 1 of the disclosure.

Legends: 100. Sound transducer; 1. Substrate; 11. Cavity; 12. First surface; 2. Fixed part; 21. Fixed end; 22. Free end; 23. Connection part; 3. Moving part; 31. Second surface; 32. Vent hole; 4. First electrode; 41. First comb finger; 42. First slot part; 421. First side wall; 4211. Insulation layer; 4212. First conductive part; 4213. Second conductive part; 422. First bottom wall; 423. Connection wall; 43. Second slot part; 431. Second side wall; 5. Second electrode; 50. Parallel member; 51. U-shaped member; 511. Parallel finger; 512. Connection finger; 52. Second comb finger; 521. First finger surface; 522. Second finger surface; 523. Interlayer; 524. Insulation area; 525. Conductive area; 53. Third comb finger; 6. Support; 7. Center; 8. Intersection point; 9. Depression.

DETAILED DESCRIPTION OF EMBODIMENTS

The disclosure is described in detail below in combination with FIGS. 1 to 21.

Example 1

As shown in FIGS. 1-6, provided is a sound transducer 100, comprising a substrate 1, a fixed part 2, a moving part 3, a first electrode 4, and a second electrode 5. The substrate 1 comprises a cavity 11 and a first surface 12 oriented to the cavity 11. The fixed part 2 extends from the first surface 12 into the cavity 11, and comprises a fixed end 21 disposed on the first surface 12 and a free end 22 opposite to the fixed end 21. The moving part 3 is fixed on the substrate 1 and disposed over the cavity 11, partially covers the cavity 11, and comprises a second surface 31 oriented to the cavity 11; the first electrode 4 is fixed on the free end 22; the second electrode 5 is fixed on the second surface 31; the first electrode 4 is laterally adjacent to the second electrode 5. In addition, in order to create a capacitor coupling between the fixed part 2 and the moving part 3, the first electrode 4 is electrically insulated with the moving part 3, and the second electrode 5 is electrically insulated with the fixed part 2.

In this example, the moving part 3 is a flexible membrane, which can be directly anchored to the substrate 1 or to a support 6 disposed on the substrate 1, and the support 6 can be a standard micromachined thin-film, or a stack of thin-films to create a membrane anchored to the substrate 1. It can be understood that the moving part 3 is not limited to the flexible membrane, as long as it can vibrate under the external force such as sound pressure. The first electrode 4 is fixed on the free end 22 of the fixed part 2, which is an immobilized fixed electrode. The second electrode 5 is fixed on the second surface 31 of the moving part 3, which is movable with the vibration of the moving part 3, and is a moving electrode.

Preferably, the first electrode and the second electrode are extendable in a direction perpendicular to the moving part.

Figure 2:
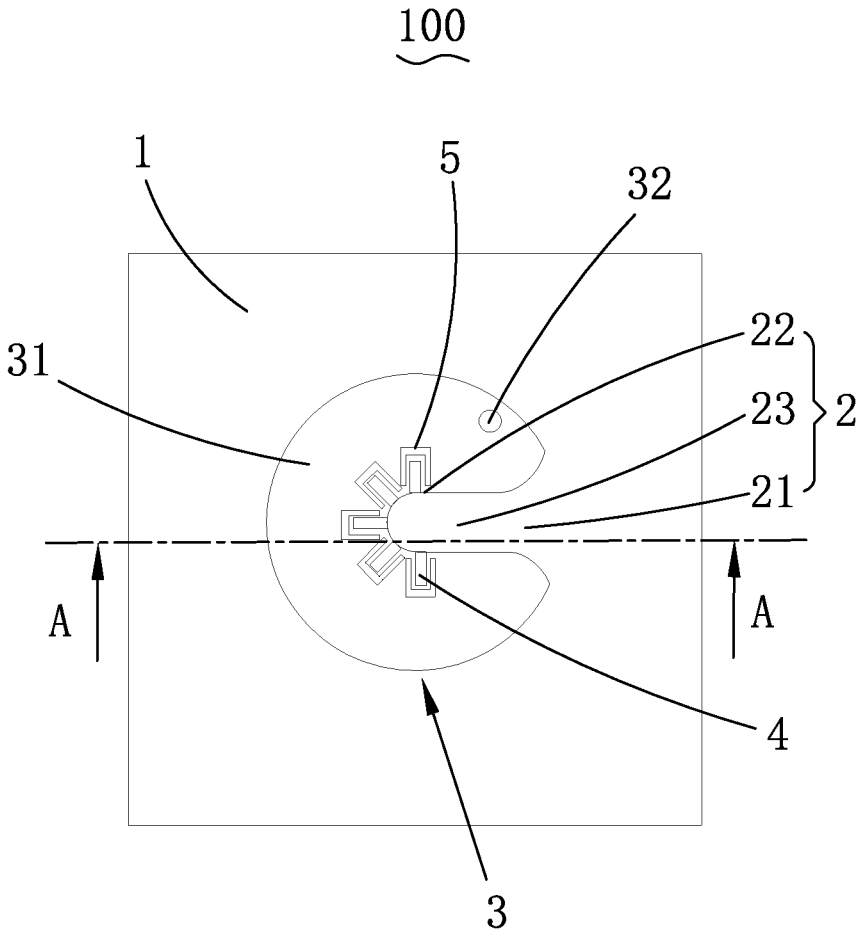
FIG. 2 is a bottom view of a sound transducer according to Example 2 of the disclosure.
Figure 3:
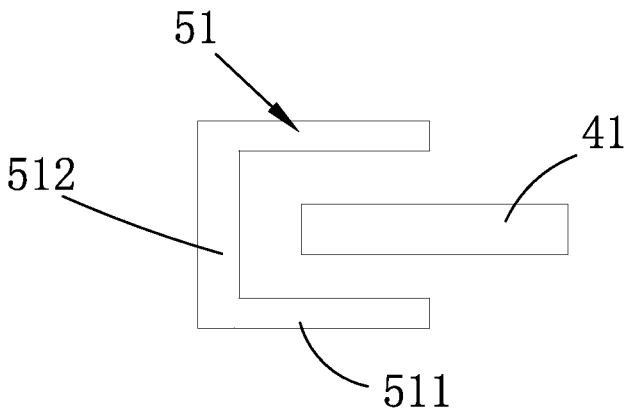
FIG. 3 shows the cooperation of a first comb finger and a U-shaped member in Example 1 of the disclosure.
Figure 4:
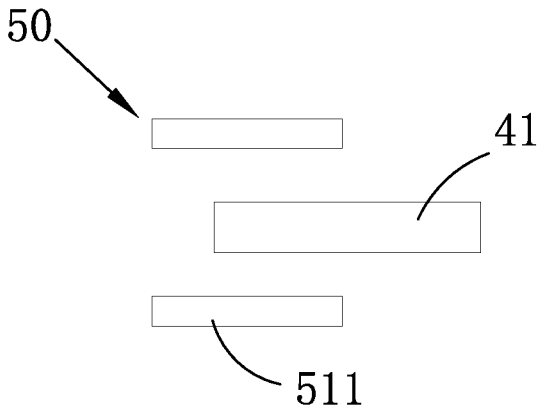
FIG. 4 shows the cooperation of a first comb finger and a parallel member in Example 1 of the disclosure.

As shown in FIGS. 2-3, the first electrode 4 comprises a plurality of first comb fingers 41; the second electrode 5 comprises a plurality of U-shaped members 51 each comprising two parallel fingers 511 and a connection finger 512 connecting the two parallel fingers 511; the plurality of first comb fingers 41 each is disposed between two corresponding parallel fingers 511, and is spaced apart from the two parallel fingers 511. In this example, the distance between each of the plurality of first comb finger 41 and two corresponding parallel fingers 511 is equal. The plurality of U-shaped members 51 and the plurality of first comb finger 41 extend in a direction perpendicular to the moving part 3, so that the opposing surfaces of the two parallel fingers 511 and the first comb finger 41 are large enough. It is understood that the first electrode 4 may comprise a plurality of U-shaped members 51, and the second electrode 5 may comprise a plurality of comb fingers. As shown in FIG. 4, in some embodiments, the second electrode 5 comprises the plurality of parallel members 50 each comprising two parallel fingers 511; the plurality of first comb fingers 41 each is disposed between two corresponding parallel fingers 511, and is spaced apart from the two parallel fingers 511. It is understood that the first electrode 4 may comprise a plurality of parallel members 50, and the second electrode 5 may comprise a plurality of comb fingers.

Figure 5:
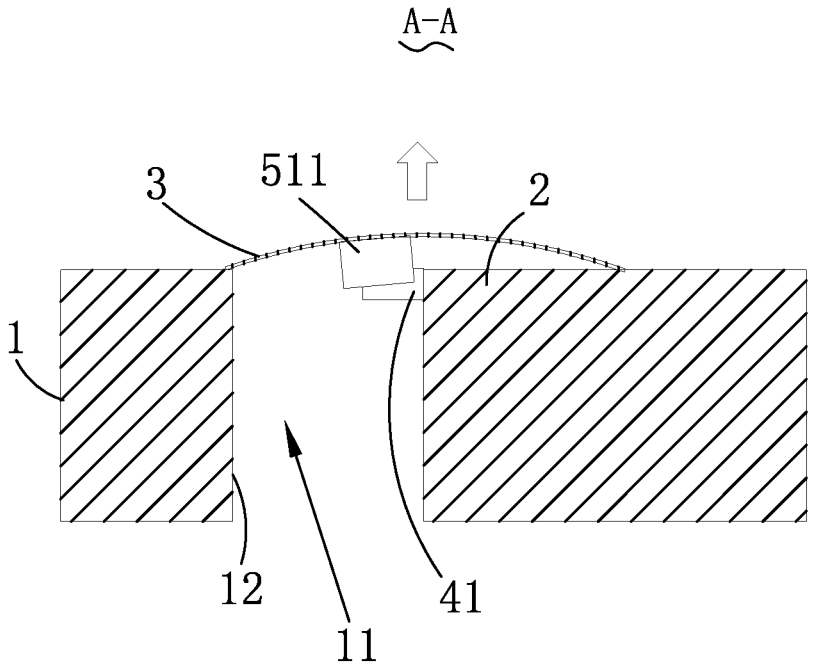
FIG. 5 illustrates that the moving part is moving away from the substrate in the angle of view taken from the line A-A in FIG. 2.
Figure 6:
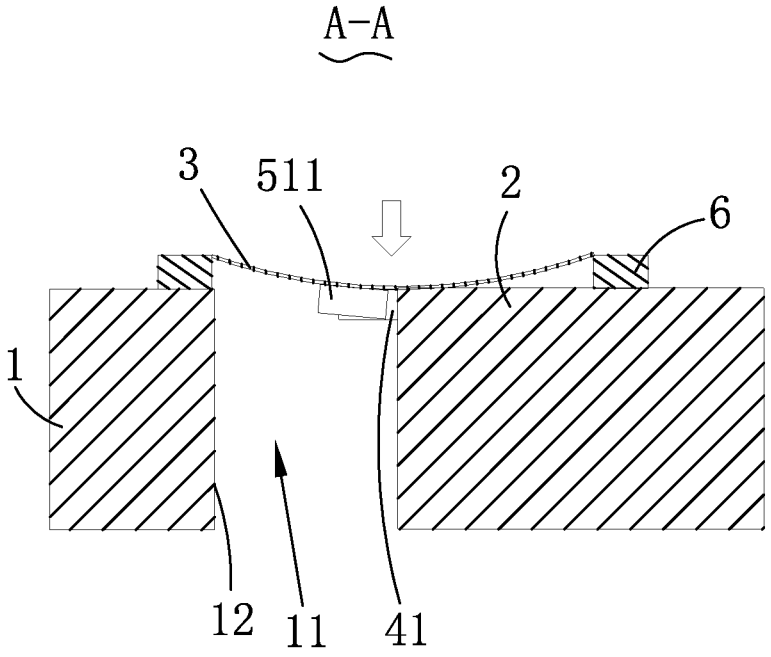
FIG. 6 illustrates that the moving part is moving towards the substrate in the angle of view taken from the line A-A in FIG. 2.

Because the capacitance is directly proportional to the area of the two plates and inversely proportional to the distance between the two plates, that is, $C=k\varepsilon_0\varepsilon_r S/d$, k is a constant, $\varepsilon_0$ is a constant, and $\varepsilon_r$ is a constant. When a sound transducer is manufactured, the value of $k\varepsilon_0\varepsilon_r$ is fixed. S refers to the area of the two plates, and d refers to the distance between the two plates. Specifically, the first comb finger 41 of the first electrode 4 of the sound transducer is inserted in a corresponding U-shaped member 51 of the second electrode 5, and the first comb finger 41 is laterally adjacent to the U-shaped member 51, so that when the first electrode 4 and the second electrode 5 are electrically coupled, a capacitor is formed between the first electrode 4 and the second electrode 5, the distance d therebetween is constant, and the area is subject to the opposing surface areas of the first electrode 4 and the second electrode 5. In the example of the disclosure, the flexible membrane vibrates under the action of an external force such as sound pressure, which changes the area of the first electrode 4 and the second electrode 5, so as to change the capacitance value and generate a signal, so the sound transducer 100 converts the sound signal into an electrical signal. FIG. 5 and FIG. 6 show that the flexible membrane vibrates under the action of an external force such as sound pressure, which drives the U-shaped member 51 to move relative to the first comb finger 41. The arrow above the figure shows the moving direction of the flexible membrane. The U-shaped member 51 moves relative to the first comb finger 41, so that the area of the two parallel fingers 511 and the first comb finger 41 varies. That is, the overlapping area for capacitive coupling is changed thereby achieving the acoustoelectric conversion. In FIG. 5, the flexible membrane is anchored directly to the substrate 1; in FIG. 6, the flexible membrane is anchored to the support 6 fixed on the substrate 1.

The second electrode 5 is fixed on the second surface 31 of the moving part 3, and is located in the center of the moving part 3. The fixed part 2 extends from the substrate 1 to the cavity 11, so that the first electrode 4 fixed on the free end 22 is laterally adjacent to the second electrode 5. When the moving part 3 vibrates under the action of an external force such as sound pressure, the second electrode 5 is driven to move in a reciprocating motion relative to the first electrode 4, so as to improve the sensitivity of the sound transducer 100. The first electrode 4 is fixed on the fixed part 2 to improve the stability of the first electrode 4, so as to avoid the displacement of the first electrode 4 caused by mechanical noise and other factors and thus improving the performance of the sound transducer 100. Therefore, the sound transducer 100 provided by the embodiment of the disclosure has higher sensitivity and the first electrode has stronger stability, thereby improving the performance of the sound transducer 100.

Refer to FIG. 1 and FIG. 2, the moving part 3 comprises a vent hole 32. By setting the vent hole 32, the static pressure on both sides of the moving part 3 is equal when the moving part 3 vibrates. The vent hole 32 can be arranged at any position of the moving part 3, for example, the vent hole 32 can also be arranged on the substrate 1. The setting position of the vent hole 32 is not limited to that in the example.

Example 2

The differences between the present example and Example 1 lie in the structure of the first electrode 4 and the second electrode 5. Only the differences are described in detail here, and other will not be described.

Figure 7:
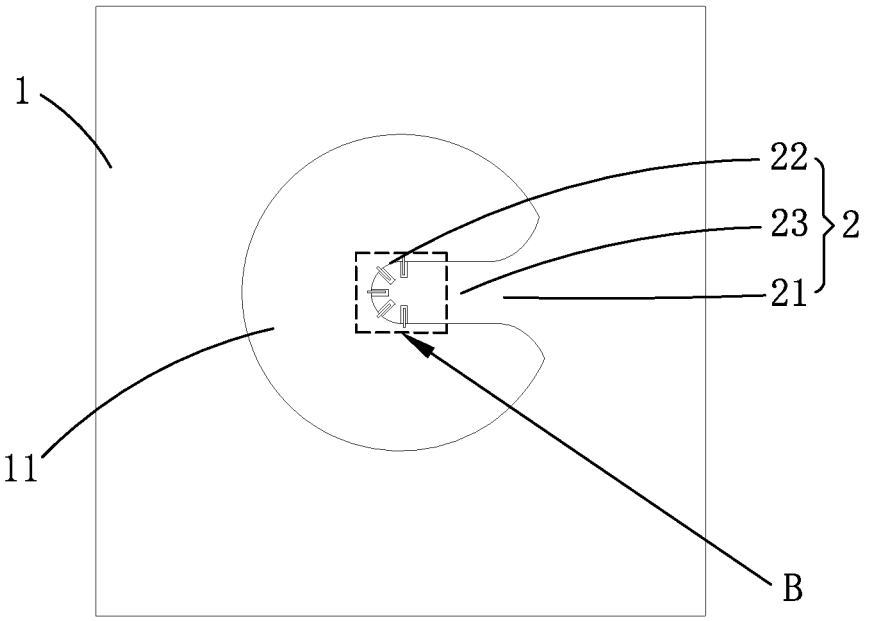
FIG. 7 is a top view of a sound transducer excluding the moving part according to Example 2 of the disclosure.
Figure 8:
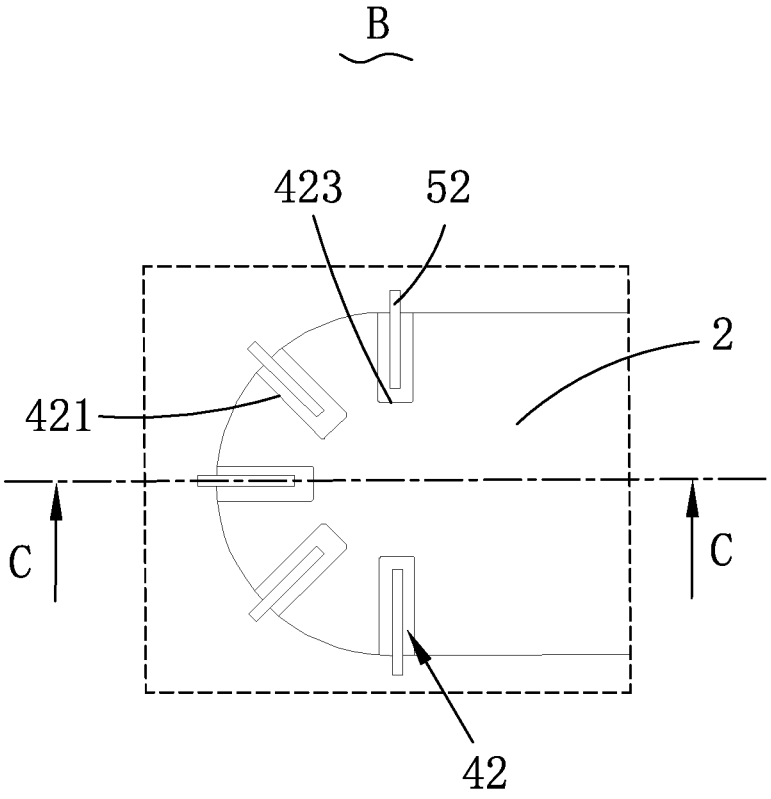
FIG. 8 is a local enlarged view of part B in FIG. 7.
Figure 9:
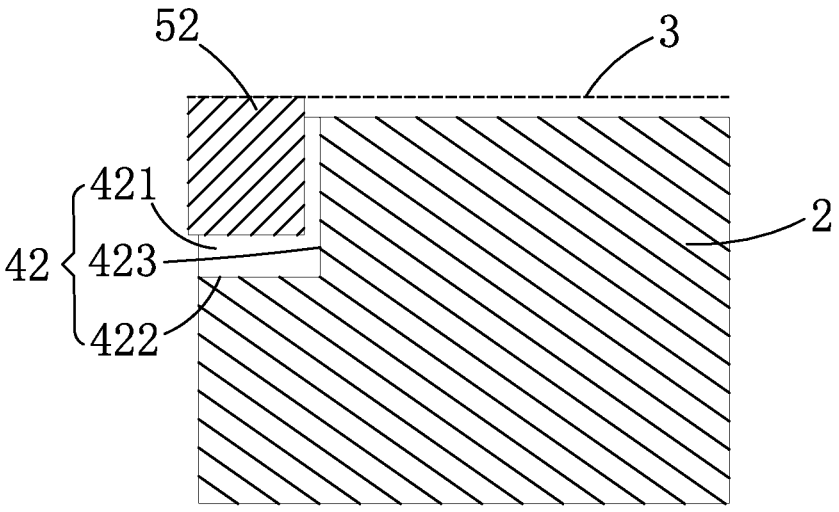
FIG. 9 is a cross sectional view taken from the line C-C in FIG. 8.

As shown in FIGS. 7-9, the free end 22 comprises a plurality of electrode slots extending from one end of free end facing the moving part 3 in a direction away from the moving part 3; the plurality of electrode slots forms the first electrode 4; the plurality of electrode slots each comprises a first slot part 42; the second electrode 5 comprises a plurality of second comb fingers 52; and the plurality of second comb fingers 52 each is disposed in a corresponding first slot part 42.

Specifically, the first slot part 42 comprises two first side walls 421 and a first bottom wall 422 connecting the two first side walls 421; the two first side walls 421 are opposite to each other; the first bottom wall 422 is disposed on one end of each of the two first side walls 421 away from the moving part 3 and is opposite to the moving part 3; and the plurality of second comb fingers 52 each is spaced apart from two corresponding first side walls 421 and a corresponding first bottom wall 422. The distance between one end of the second comb finger 52 away from the moving part 3 and the first bottom wall 422 limits the displacement of the second comb finger 52 towards the fixed part 2. Therefore, it is necessary and important to set a large enough gap between the one end of the second comb finger 52 away from the moving part 3 and the first bottom wall 422 according to the actual situation. The displacement of the second comb finger 52 towards the fixed part 2 is controlled by an external force such as the sound pressure acting on the moving part 3. In this embodiment, the distance between the second comb finger 52 and the two first side walls 421 is equal, and in other embodiments, the distance between the second comb finger 52 and the two first side walls 421 may be unequal.

Preferably, the first slot part 42 further comprises a connection wall 423 extending along a direction perpendicular to the moving part 3; the connection wall 423 is connected to the two first side walls 421 and the first bottom wall 422; a plurality of first slot parts 42 are arranged in a semicircle or circle, and the center 7 of the semicircle or circle is disposed on one end of the connection wall 423. As shown in FIG. 8, the plurality of first slot parts 42 are arranged in a semicircle; in other embodiments, the plurality of first slot parts 42 may be distributed in a semicircle or in any shape such as a triangle or a quadrilateral, which is not limited to the shape provided in the present embodiment and the attached drawings.

Example 3

The differences between the present example and Example 2 lie in the structure of the first slot part 42 and the configuration thereof. Only the differences are described in detail here, and other will not be described.

Figure 10:
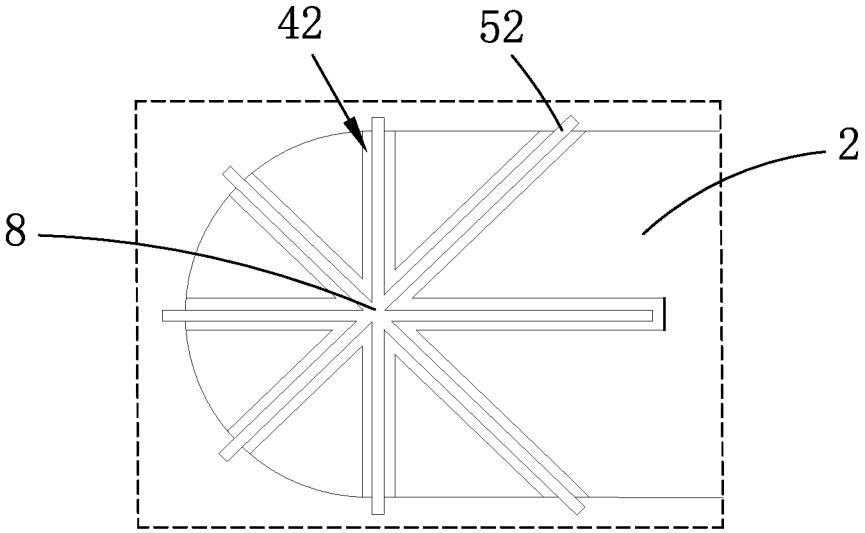
FIGS. 10, 11, 13, 15, 17, and 20 are variants of FIG. 8.
Figure 11:
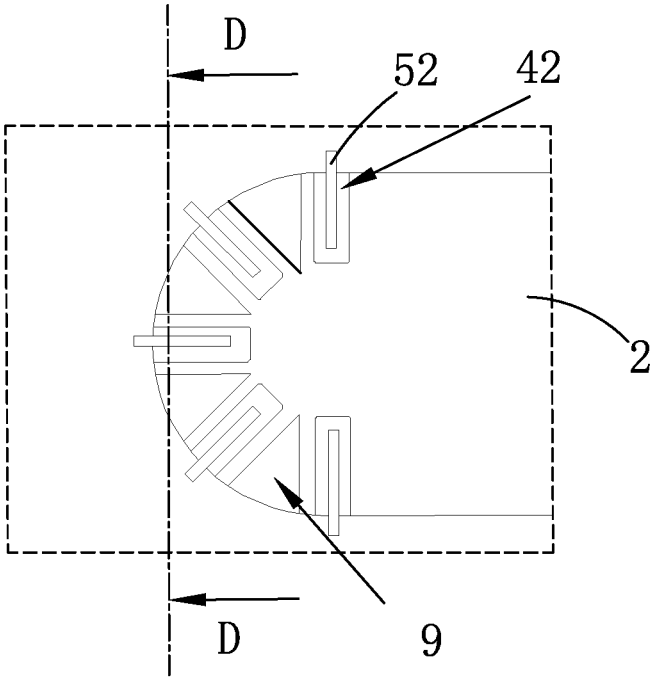
Figure 12:
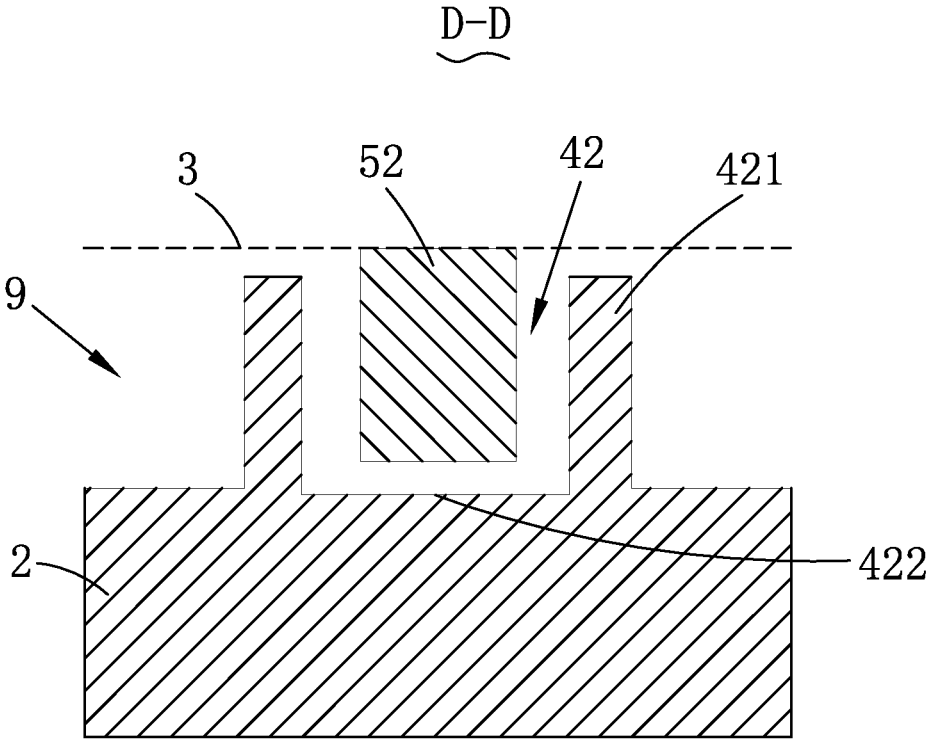
FIG. 12 is a cross sectional view taken from the line D-D in FIG. 11.
Figure 13:
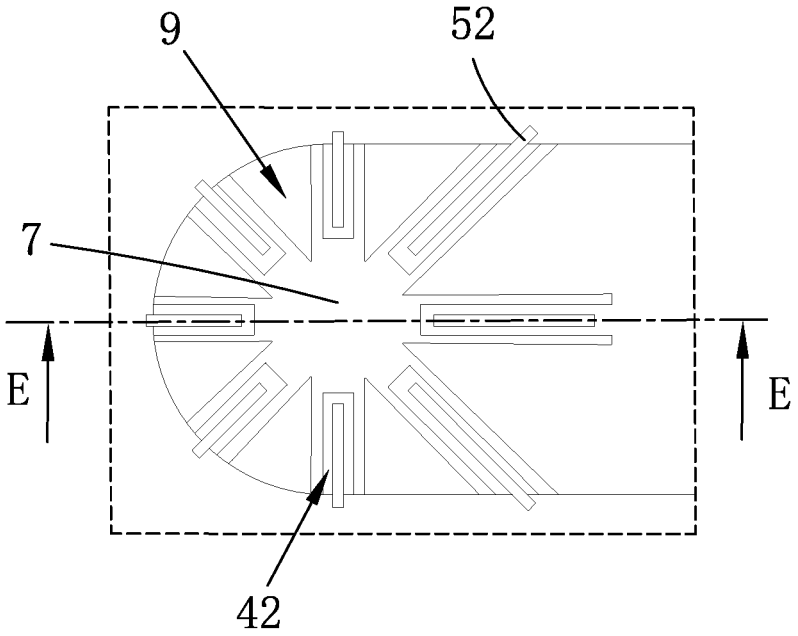
Figure 14:
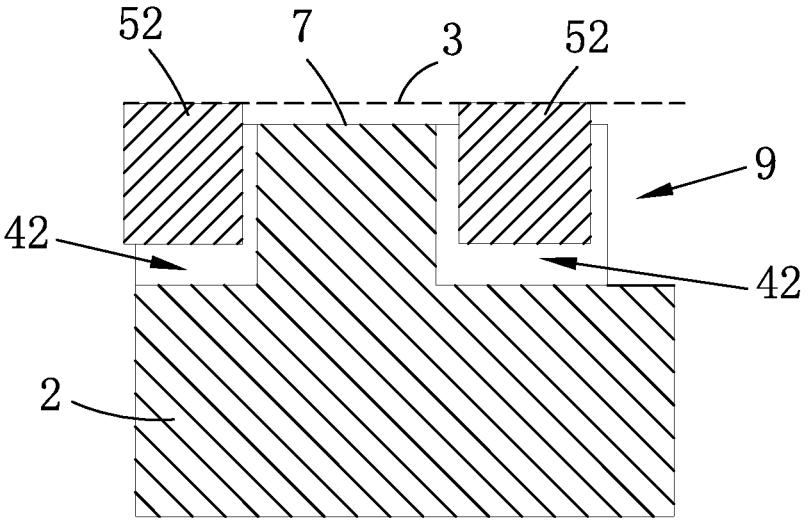
FIG. 14 is a cross sectional view taken from the line E-E in FIG. 13.
Figure 15:
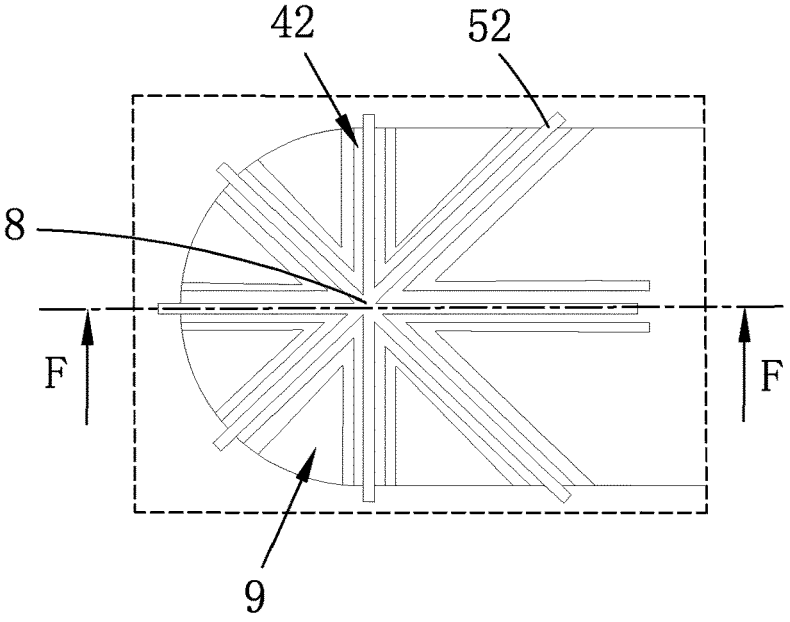
Figure 16:
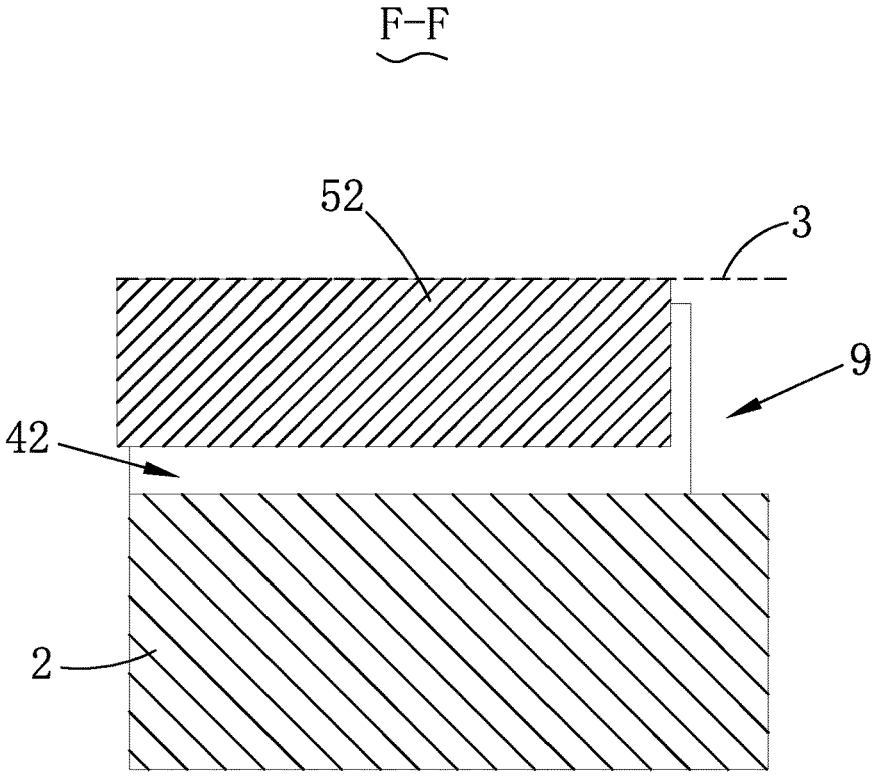
FIG. 16 is a cross sectional view taken from the line F-F in FIG. 15.

As shown in FIG. 10, the first slot part 42 comprises no connection wall 423. The plurality of first slot parts 42 intersects on an intersection point, and the plurality of first slot parts 42 is radially distributed from the intersection point, that is, the plurality of first slot parts 42 communicates with each other. It can be understood that a plurality of first slot parts 42 can also be disposed in a cross manner.

Example 4

The differences between the present example and Example 2 lie in that a depression 9 is disposed between two first side walls 421 of two adjacent first slot parts 42. Only the differences are described in detail here, and other will not be described.

As shown in FIG. 10, the depression 9 is disposed between two first side walls 421 of two adjacent first slot parts 42, and extends from one end of the fixed part 2 opposite to the moving part 3 along a direction away from the moving part 3. By disposing the setting the depression 9, the gap between the flexible membrane and the fixed part 2 is increased, so as to reduce the membrane damping when the flexible membrane moves towards the fixed part 2, thus improving the performance of the sound transducer 100.

Example 5

The differences between the present example and Example 2 lie in the configuration position of the depression 9. Only the differences are described in detail here, and other will not be described.

Preferably, the fixed part 2 further comprises a connection part 23 connecting the fixed end 21 and the free end 22; and the depression 9 is disposed on both the connection part 23 and the fixed end 21. By disposing the setting the depression 9, the gap between the flexible membrane and the fixed part 2 is increased, so as to reduce the membrane damping when the flexible membrane moves towards the fixed part 2, thus improving the performance of the sound transducer 100. In other embodiments, the depression 9 may be provided only on the connection part 23, or the depression 9 may be provided only on the fixed end 21, or the depression 9 may be disposed simultaneously between the two first side walls 421 of two adjacent first slot parts 42, on the connection part 23, and on the fixed end 21. It can be understood that the configuration position of the depression 9 is not limited by the embodiments and the drawings of the disclosure.

Example 6

The differences between the present example and Example 2 lie in the depression 9 is disposed on the fixed part 2. Only the differences are described in detail here, and other will not be described.

Figure 17:
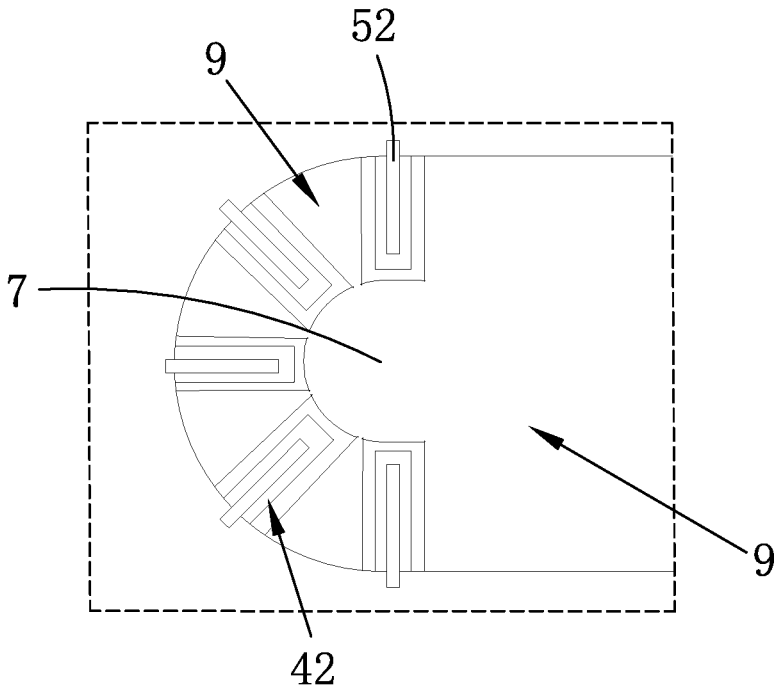

As shown in FIG. 17, the depression 9 may be disposed on the center 7, on between the two first side walls 421 of two adjacent first slot parts 42, on the connection part 23, and on the fixed end 21. By disposing the setting the depression 9, the gap between the flexible membrane and the fixed part 2 is increased, so as to reduce the membrane damping when the flexible membrane moves towards the fixed part 2, thus improving the performance of the sound transducer 100. In other embodiments, the depression 9 is disposed only on the center 7. It can be understood that the configuration position of the depression 9 is not limited by the embodiments and the drawings of the disclosure.

Example 7

The differences between the present example and Example 2 lie in that the plurality of electrode slots each comprises a second slot part 43 and the second electrode 5 comprises a plurality of third comb fingers 53. Only the differences are described in detail here, and other will not be described.

Preferably, the plurality of electrode slots each comprises a second slot part 43 disposed on one end of the first slot part 42 away from the center 7 and intersecting with the first slot part 42; the second electrode 5 comprises a plurality of third comb fingers 53 connecting to the plurality of second comb fingers 52, respectively, and disposed in the second slot part 43. By disposing the second slot part 43 and the third comb finger 53 inserted in the second slot part 43, the area of the first electrode 4 and the second electrode 5 is increased, thus increasing the overlapping area for capacitive coupling, and improving the sensitivity of the sound transducer 100.

Figure 18:
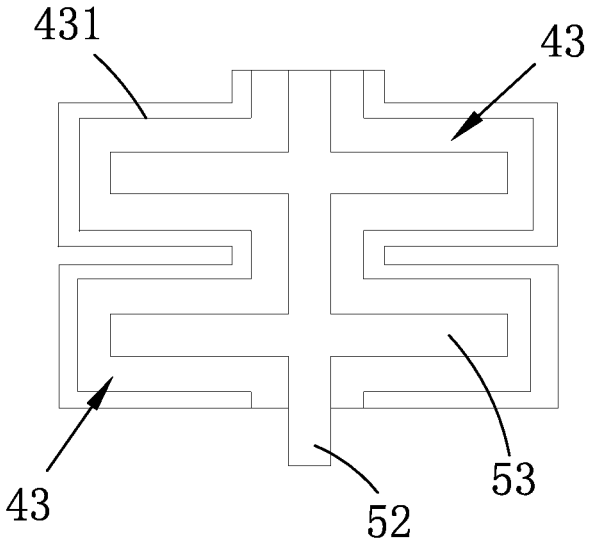
FIG. 18 shows the cooperation of a second slot part and a third comb finger in FIG. 8.

As shown in FIG. 18, the second slot part 43 comprises two second side walls 431 and a second bottom wall (not shown) connecting the two second side walls 431; the two second side walls 431 are opposite to each other; the second bottom wall is disposed on one end of each of the two second side walls 431 away from the moving part 3 and is opposite to the moving part 3; and the plurality of third comb fingers 53 each is spaced apart from two corresponding second side walls 431 and a corresponding second bottom wall.

The distance between one end of the third comb finger 53 away from the moving part 3 and the second bottom wall limits the displacement of the third comb finger 53 towards the fixed part 2. Therefore, it is necessary to set a large enough gap between the one end of the third comb finger 53 away from the moving part 3 and the second bottom wall according to the actual situation. The displacement of the third comb finger 53 towards the fixed part 2 is controlled by an external force such as the sound pressure acting on the moving part 3. In this embodiment, the distance between the third comb finger 52 and the two second side walls 431 is equal, and in other embodiments, the distance between the third comb finger 53 and the two second side walls 431 may be unequal. In addition, the shape of the second slot part 43 is not limited to that taught in the drawings.

Example 8

The differences between the present example and Example 3 lie in that the plurality of electrode slots each comprises a second slot part 43 and the second electrode 5 comprises a plurality of third comb fingers 53. Only the differences are described in detail here, and other will not be described.

Preferably, the plurality of electrode slots each comprises a second slot part 43 disposed on one end of the first slot part 42 away from the intersection point 8 and intersecting with the first slot part 42; the second electrode 5 comprises a plurality of third comb fingers 53 connecting to the plurality of second comb fingers 52, respectively, and disposed in the second slot part 43. By disposing the second slot part 43 and the third comb finger 53 inserted in the second slot part 43, the area of the first electrode 4 and the second electrode 5 is increased, thus increasing the overlapping area for capacitive coupling, and improving the sensitivity of the sound transducer 100.

Figure 19:
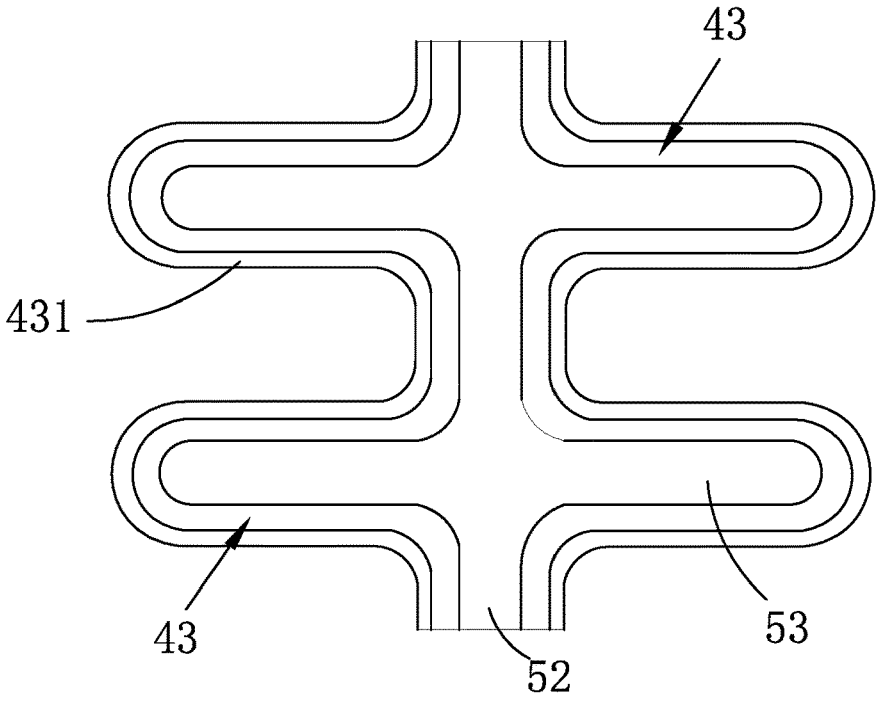
FIG. 19 shows the cooperation of a second slot part and a third comb finger in FIG. 9.

As shown in FIG. 19, the second slot part 43 comprises two second side walls 431 and a second bottom wall (not shown) connecting the two second side walls 431; the two second side walls 431 are opposite to each other; the second bottom wall is disposed on one end of each of the two second side walls 431 away from the moving part 3 and is opposite to the moving part 3; and the plurality of third comb fingers 53 each is spaced apart from two corresponding second side walls 431 and a corresponding second bottom wall.

The distance between one end of the third comb finger 53 away from the moving part 3 and the second bottom wall limits the displacement of the third comb finger 53 towards the fixed part 2. Therefore, it is necessary to set a large enough gap between the one end of the third comb finger 53 away from the moving part 3 and the second bottom wall according to the actual situation. The displacement of the third comb finger 53 towards the fixed part 2 is controlled by an external force such as the sound pressure acting on the moving part 3. In this embodiment, the distance between the third comb finger 52 and the two second side walls 431 is equal, and in other embodiments, the distance between the third comb finger 53 and the two second side walls 431 may be unequal. In addition, the shape of the second slot part 43 is not limited to that taught in the drawings.

Example 9

The differences between the present example and Example 4 lie in the first electrode and the second electrode both comprise an insulation area. Only the differences are described in detail here, and other will not be described.

Figure 20:
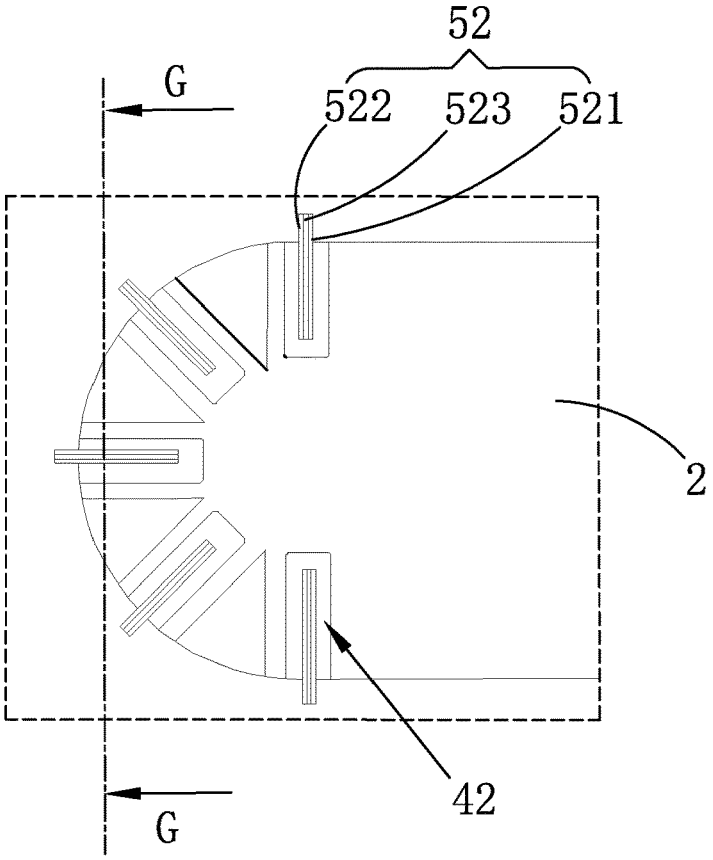
Figure 21:
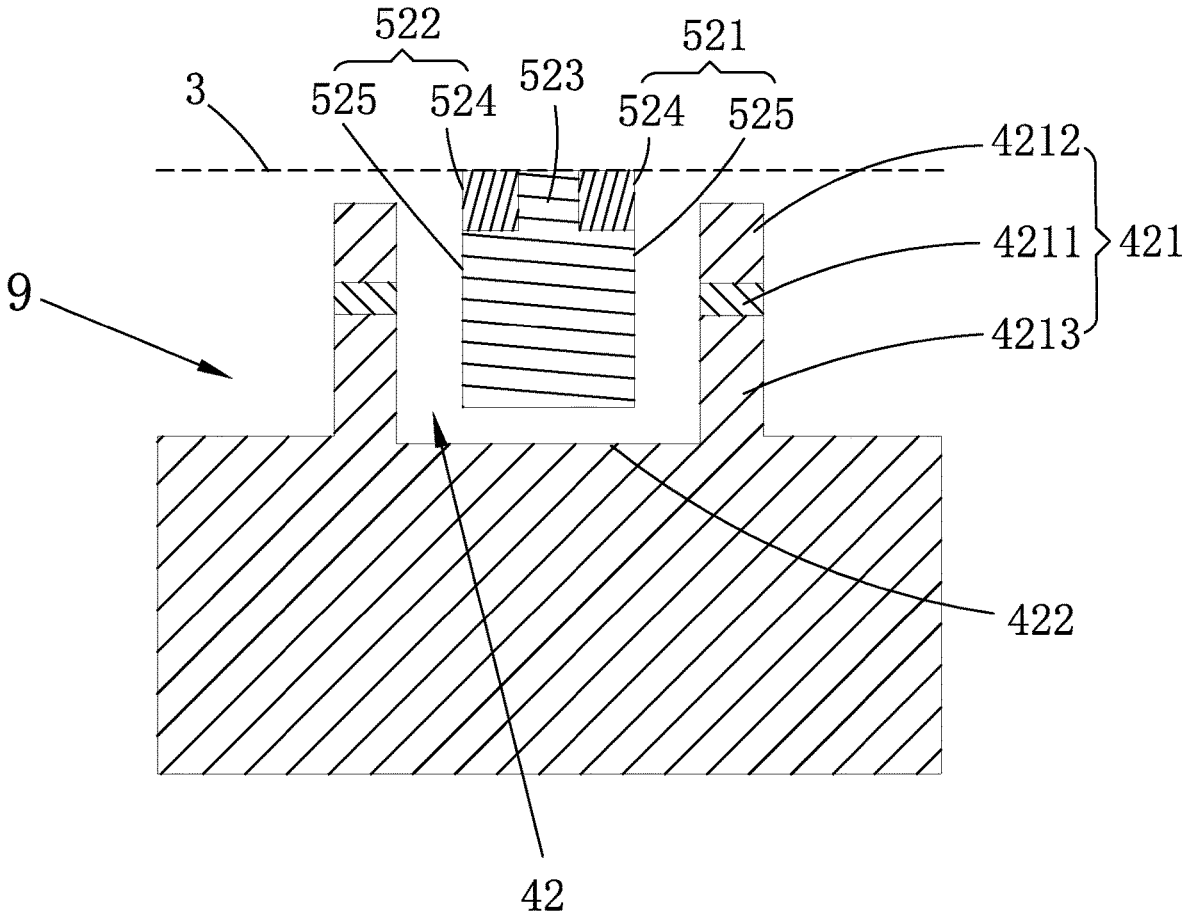
FIG. 21 is a cross sectional view taken from the line G-G in FIG. 20.

As shown in FIGS. 20-21, each first side wall 421 is provided with an insulation layer 4211; the first side wall 421 comprises a first conductive part 4212, the insulation layer 4211, and a second conductive part 4213 consecutively; the plurality of second comb fingers 52 each comprises a first finger surface 521, a second finger surface 522 opposite to the first finger surface, and an interlayer 523 disposed between the first finger surface 521 and the second finger surface 522; the first finger surface 521 and the second finger surface 522 are opposite to the two first side walls 421 of the first slot part 42, respectively; the first finger surface 521 and the second finger surface 522 each comprise an insulation area 524 and a conductive area 525 in a direction from the moving part to the fixed part, and the interlayer 523 is conductive; and the first conductive part 4212 is opposite to the insulation area 524 and the conductive area 525. The design can reduce the sensing area of the second electrode 5 and obtain two different sensing signals. For example, when the second electrode 5 moves close to the moving part 3, the area of the second comb finger 52 and the second conductive part 4213 is reduced, and the area of the second comb finger 52 and the first conductive part 4212 is increased, so differential sensing can be generated and the performance of the sound transducer 100 is improved.

It can be understood that in any one of Examples 2, 3, 5 and 8, the first side wall can also be provided with an insulation layer, and correspondingly, the first finger surface and the second finger surface of the second comb finger each comprise an insulation area and a conductive area; similarly, in any one of Examples 7 and 8, the second side wall can also be provided with an insulation layer, and accordingly, the finger surface of the third comb finger may comprise an insulation area and a conductive area; in Example 1, the first comb finger may also be provided with an insulation layer, and correspondingly, the surface of the two parallel fingers opposite to the first comb finger may comprise an insulation area and a conductive area. It should be noted that the configuration mode of the insulation layer is not limited to that shown in the embodiments and figures of the disclosure.

Example 10

An electronic device comprising a sound transducer 100 in any one of Examples 1 to 9 is provided.

The above description is only the embodiment of the disclosure. It should be noted that for those skilled in the related art, improvements can be made without departing from the inventive concept of the disclosure, but these belong to the protection scope of the invention.

What is claimed is:

1. A sound transducer, comprising:

a substrate comprising a cavity and a first surface oriented to the cavity;

a fixed part extending from the first surface into the cavity, and comprising a fixed end disposed on the first surface and a free end opposite to the fixed end;

a moving part fixed on the substrate and disposed over the cavity, partially covering the cavity, and comprising a second surface oriented to the cavity;

a first electrode, fixed on the free end; and a second electrode fixed on the second surface;

wherein the first electrode is laterally adjacent to the second electrode;

the free end comprises a plurality of electrode slots perpendicular to the moving part; the plurality of electrode slots forms the first electrode; the plurality of electrode slots each comprises a first slot part; the second electrode comprises a plurality of second comb fingers; and the plurality of second comb fingers each is disposed in a corresponding first slot part.

2. The sound transducer of claim 1, wherein the first electrode and the second electrode are extendable in a direction perpendicular to the moving part.

3. The sound transducer of claim 2, wherein the first electrode comprises a plurality of first comb fingers; the second electrode comprises a plurality of parallel members each comprising two parallel fingers, the plurality of first comb fingers each is disposed between two corresponding parallel fingers, and is spaced apart from the two parallel fingers; or the second electrode comprises a plurality of U-shaped members each comprising two parallel fingers and a connection finger connecting the two parallel fingers, the plurality of first comb fingers each is disposed between two corresponding parallel fingers, and is spaced apart from the two parallel fingers.

4. The sound transducer of claim 2, wherein the first slot part comprises two first side walls and a first bottom wall connecting the two first side walls; the two first side walls are opposite to each other; the first bottom wall is disposed on one end of each of the two first side walls away from the moving part and is opposite to the moving part; and the plurality of second comb fingers each is spaced apart from two corresponding first side walls and a corresponding first bottom wall.

5. The sound transducer of claim 4, wherein the first slot part further comprises a connection wall extending along a direction perpendicular to the moving part; the connection wall is connected to the two first side walls and the first bottom wall; a plurality of first slot parts are arranged in a semicircle or circle, and a center of the semicircle or circle is disposed on one end of the connection wall.

6. The sound transducer of claim 4, wherein a plurality of first slot parts intersects on an intersection point, and the plurality of first slot parts is radially distributed from the intersection point.

7. The sound transducer of claim 4, wherein a depression is disposed between two first side walls of two adjacent first slot parts, and extends from one end of the fixed part opposite to the moving part along a direction away from the moving part.

8. The sound transducer of claim 7, wherein the fixed part further comprises a connection part connecting the fixed end and the free end; and the depression is disposed on both the connection part and the fixed end.

9. The sound transducer of claim 5, wherein a depression is disposed on the center of the semicircle or circle, and extends from one end of the fixed part opposite to the moving part along a direction away from the moving part.

10. The sound transducer of claim 5, wherein the plurality of electrode slots each comprises a second slot part disposed on one end of the first slot part away from the center and intersecting with the first slot part; the second electrode comprises a plurality of third comb fingers connecting to the plurality of second comb fingers, respectively, and disposed in the second slot part.

11. The sound transducer of claim 6, wherein the plurality of electrode slots each comprises a second slot part disposed on one end of the first slot part away from the intersection point and intersecting with the first slot part; the second electrode comprises a plurality of third comb fingers connecting to the plurality of second comb fingers, respectively, and disposed in the second slot part.

12. The sound transducer of claim 10, wherein the second slot part comprises two second side walls and a second bottom wall connecting the two second side walls; the two second side walls are opposite to each other; the second bottom wall is disposed on one end of each of the two second side walls away from the moving part and is opposite to the moving part; and the plurality of third comb fingers each is spaced apart from two corresponding second side walls and a corresponding second bottom wall.

13. The sound transducer of claim 4, wherein each first side wall is provided with an insulation layer; the first side wall comprises a first conductive part, the insulation layer, and a second conductive part consecutively; the plurality of second comb fingers each comprises a first finger surface, a second finger surface opposite to the first finger surface, and an interlayer disposed between the first finger surface and the second finger surface; the first finger surface and the second finger surface are opposite to the two first side walls of the first slot part, respectively; the first finger surface and the second finger surface each comprise an insulation area and a conductive area in a direction from the moving part to the fixed part, and the interlayer is conductive; and the first conductive part is opposite to the insulation area and the conductive area.

14. An electronic device, comprising a sound transducer of claim 1.

15. The electronic device of claim 14, wherein the first electrode and the second electrode are extendable in a direction perpendicular to the moving part.

16. The electronic device of claim 15, wherein the first electrode comprises a plurality of first comb fingers; the second electrode comprises a plurality of U-shaped members each comprising two parallel fingers and a connection finger connecting the two parallel fingers; the plurality of first comb fingers each is disposed between two corresponding parallel fingers, and is spaced apart from the two parallel fingers.

17. The electronic device of claim 15, wherein the first slot part comprises two first side walls and a first bottom wall connecting the two first side walls; the two first side walls are opposite to each other; the first bottom wall is disposed on one end of each of the two first side walls away from the moving part and is opposite to the moving part; and the plurality of second comb fingers each is spaced apart from two corresponding first side walls and a corresponding first bottom wall.

18. The sound transducer of claim 11, wherein the second slot part comprises two second side walls and a second bottom wall connecting the two second side walls; the two second side walls are opposite to each other; the second bottom wall is disposed on one end of each of the two second side walls away from the moving part and is opposite to the moving part; and the plurality of third comb fingers each is spaced apart from two corresponding second side walls and a corresponding second bottom wall.

* * * * *